United States Patent [19]

Sanden et al.

[11] 4,004,813

[45] Jan. 25, 1977

[54] LOTTERY-TICKET ASSEMBLY

[76] Inventors: Stig Ingemar Sandén, Apelvagen 7, S-241 00; Gertrud Marianne Sandén, Sturegatan 50, S-241 00, both of Eslov, Sweden

[22] Filed: Mar. 12, 1975

[21] Appl. No.: 557,586

[52] U.S. Cl. ..... 273/139; 206/39.1; 283/8 R

[51] Int. Cl.[2] ..... G07C 15/00

[58] Field of Search ..... 221/26, 70, 69, 92; 206/39–39.8; 312/50; 283/6, 8; 273/139; 211/54, 57

[56] References Cited

UNITED STATES PATENTS

| | | | |
|---|---|---|---|
| 1,462,448 | 7/1923 | Fedoern | 206/39.1 |
| 1,691,455 | 11/1928 | Bates | 273/139 X |
| 1,713,241 | 5/1929 | Rice | 273/139 UX |
| 3,307,858 | 3/1967 | Sanden | 206/39.1 X |

FOREIGN PATENTS OR APPLICATIONS

| | | | |
|---|---|---|---|
| 800,116 | 4/1936 | France | 273/139 |

*Primary Examiner*—Drayton E. Hoffman
*Assistant Examiner*—Francis J. Bartuska
*Attorney, Agent, or Firm*—John J. Dennemeyer

[57] ABSTRACT

A lottery-ticket assembly is disclosed in which lottery tickets are arranged in an upstanding position to project upwardly from a container. Upstanding lottery-ticket strips are anchored in the container and are stacked in side-by-side relation and relatively spaced by spacer strips. Each ticket strip has a plurality of tongues projecting upwardly from the container and tear-off lines in the base portion of the ticket strip to separate from the base portion a pulling portion of each tongue, the pulling portion being provided with a lottery-ticket designation.

4 Claims, 7 Drawing Figures

LOTTERY-TICKET ASSEMBLY

The present invention relates to a lottery-ticket assembly in which lottery tickets are arranged in an upstanding position to project upward from a container.

Previously, there has been a trend towards providing small-size lottery-ticket blocks in the form of handy units, i.e. units which, for example, can be held by one hand of the lottery-ticket seller, while the lottery-ticket buyer can leaf through the lottery-ticket block, select a lot, and withdraw the lot from the sealing box of the lottery-ticket block.

The present invention is directed to a novel alternative to the use of such lottery-ticket blocks, viz. a lottery-ticket assembly in which lottery tickets are arranged in an upstanding position to project upward from a container, whereby the lottery-ticket seller will be able to arrange lottery tickets in the form of a file somewhat similar to a card-index, and the lottery-ticket buyer will, on the one hand, obtain a good survey even if the number of lots per unit is large, and, on the other hand will be capable of readily selecting lottery tickets, for instance by leafing through the latter, and to withdraw tickets one by one without the other tickets hiding or obstructing the withdrawal.

It is an object of the present invention to enable this novel lottery-ticket assembly to be manufactured at reasonable cost, and at the same time to ensure that the tickets shall be protected against unauthorized manipulations. These objects will be attained by imparting to the lottery-ticket assembly the specific features defined in the appended claims.

The invention will be described in greater detail hereinafter with reference to the accompanying drawings, in which.

Figure 1:
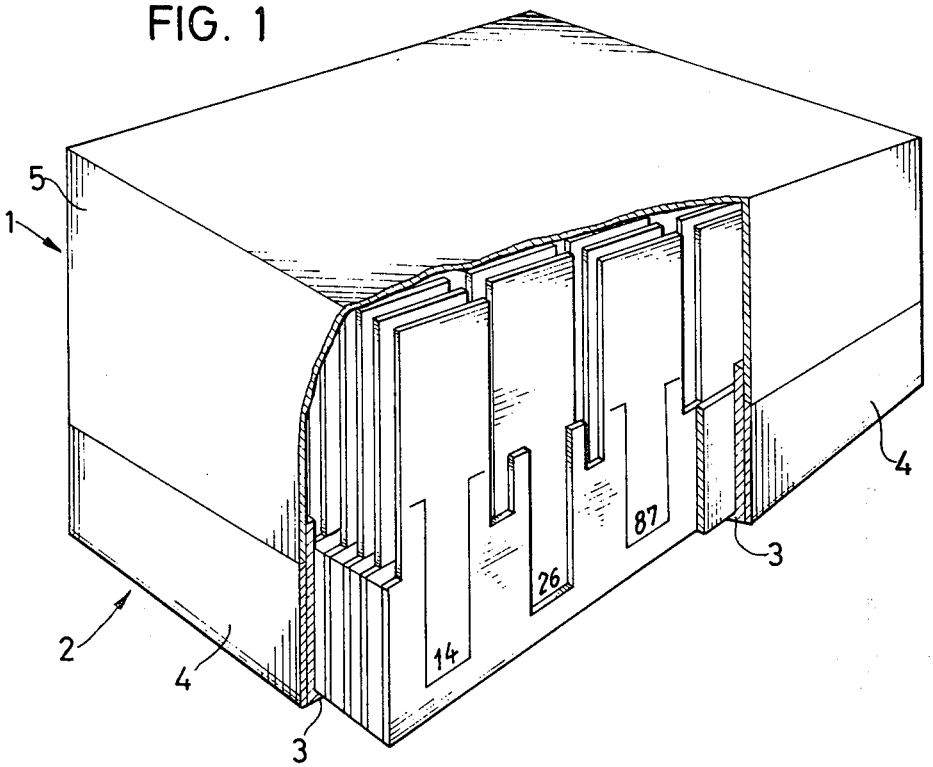
FIG. 1 is a partially broken-away perspective view illustrating a lottery-ticket package according to the present invention.
Figure 2:
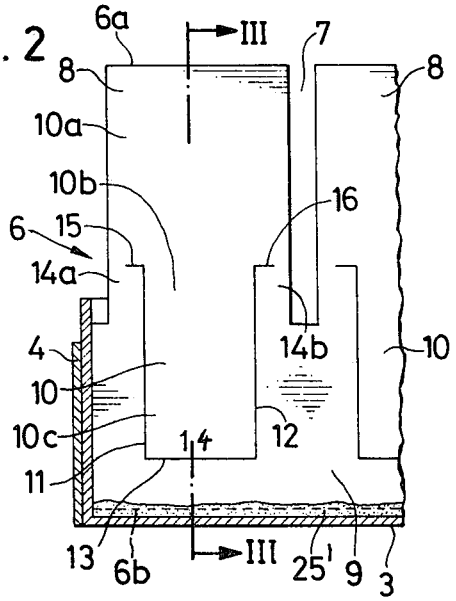
FIG. 2 is a cross-sectional view illustrating a portion of the package.
Figure 3:
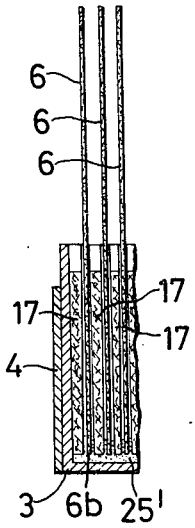
FIG. 3 illustrates a cross-section taken along lines III—III in FIG. 2.

The package according to the embodiment illustrated by way of example in the drawing comprises a container or case 1 comprising a bottom portion 2 consisting of a bottom 3 and side walls 4 upstanding from the bottom. The case 1 further comprises a top portion 5 adapted to be assembled with the bottom portion 2 so as to form an advantageously completely closed container within which lottery-ticket strips 6 may be disposed so as to be satisfactorily protected when the top portion 5 is assembled with the bottom portion 2 and to be accessible for withdrawal after removal of the top portion 5.

According to the embodiment illustrated by way of example, the lottery-ticket strips 6 are in the form of rectangular leaves (such as paper or cardboard sheets) which comprise spaced parallel slots 7 for forming a number of (preferably five) slips or tongues 8 which are disposed in spaced side-by-side relation along one longitudinal edge **6*a* of each lottery-ticket strip 6. Further, each strip 6 is provided with so-called tear-off lines, i.e. punched and/or weakening lines and/or perforation lines, for forming pulling portions 10 in the base portion 9 of the strip 6. Said lines are disposed in a specific manner, so that each pulling portion 10 will comprise the outer-end portion 10*a* of the related tongue 8, a central portion 10*b* of the inner portion of the related tongue 8 and an extension 10*c* of this central portion, the end of said extension being slightly spaced from the other longitudinal edge 6*b* of the respective lottery-ticket strip 6. To form this arrangement, in respect of each pulling portion 10, two substantially parallel lines 11, 12, passing through the inner portion of each tongue 8, are disposed in spaced relation to, and approximatively parallel to the two opposite sides of the tongue 8 and extending further towards the other longitudinal edge 6*b* of each ticket strip. The lines 11, 12 terminate in spaced relation to said edge 6*b* and are connected with a line 13. This disposition of lines involves the fact that each pulling portion 10 will only be connected to the base portion 9 of the strip through transition parts 14*a*, 14*b* which are constituted by the tongue outside lines 11, 12 and the central portion 10*b*. Upon withdrawal, in order to enable the pulling portion 10 to be torn off at a definite location of the sealing or transition portions 14*a*, 14*b*, a line 15 is arranged which extends from the line 11 toward one edge of the tongue 8, and a line 16 which extends from line 12 toward the opposite edge of the tongue 8. Such lines 15, 16 may be made relatively short and terminate in sufficiently spaced relation to the edges of tongue 8 to prevent the connection between the pulling portion 10 and the base portion of the strip 6** from becoming too weak.

The lottery-ticket strips 6 may be manufactured by automated machinery in one or more steps of operation, and such automated manufacturing may also include printing of lot numbers and/or designations ("14", "26" and "87" in the drawings) on the portions **10*c* of the pulling portions 10, and preferably in the vicinity of the base lines 13**.

According to the invention, the lottery-ticket assembly includes spacer strips 17 which are intended to be interleaved with the ticket strips 6 to hide the lot numbers or designations, to prevent any attempts to re-seal a lot which has been broken, and to facilitate the pulling-out of lots by at least slightly spacing the lottery-tickets from one another. In its simplest form, each spacerstrip 17 is constituted by an elongated paper or cardboard strip of a thickness which is greater than that of the lottery-ticket strips, and the height of which is so dimensioned as to cause the same to project above the lot numbers or designations of the pulling portions 10 when disposed flush with the longitudinally extending bottom edges of the ticket strips.

Figure 5:
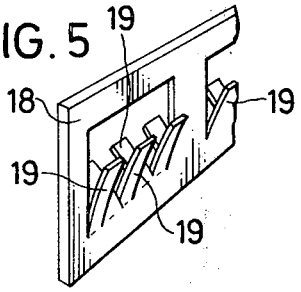
FIG. 5 is a perspective view illustrating a spacer strip of an alternative design.
Figure 6:
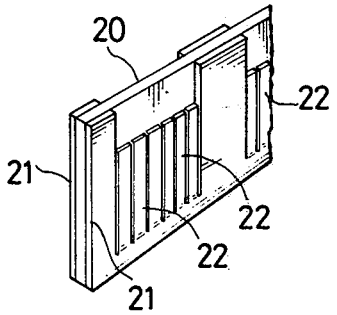
FIG. 6 is a perspective view illustrating a spacer strip according to a further alternative embodiment.

The spacer strip 17 preferably is provided with reinsertion guards adapted to prevent re-insertion of pulling portions 10 which have been broken. Such re-insertion guards may be made in any of a great number of designs, two of which are illustrated in FIGS. 5 and 6. In a suitable type of spacer strip 18, illustrated in FIG. 5, a number of lugs 19 have been punched out, and these lugs are "biased" so as to flex out laterally when the pulling portion 10 has been removed, thus forming a bar to any reinsertion of the latter. As an alternative solution, the spacer strip 20 (FIG. 6) comprises two thin sheets 21 having punched-out lugs 22 and which are attached (e.g. pasted) to the opposite side surfaces of the spacer strip 20 in a manner to cause the lugs 22 to lie substantially freely, thereby barring any reinsertion of the pulling portion 10 into its former proper position after its sealing connection with the base portion of the lottery-ticket strip having been broken.

Figure 4:
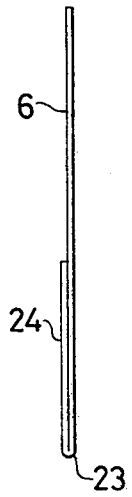
FIG. 4 is a side-elevational view illustrating a lottery-ticket strip of an alternative design.

FIG. 4 illustrates an alternative design of the lottery-ticket strip 6. In this case the lottery-ticket strip is folded along a foldng line 23, and the folded-up portion 24 will form a pocket for the reception of each ticket of the strip 6. The folded-up portion 24, if desired, may be provided with punched-out lugs (not shown) for preventing re-insertion of a drawn lot into its sealed position. The folded-up portion 24, in addition, could be utilized as a spacer instead of separate spacer strips.

Figure 7:
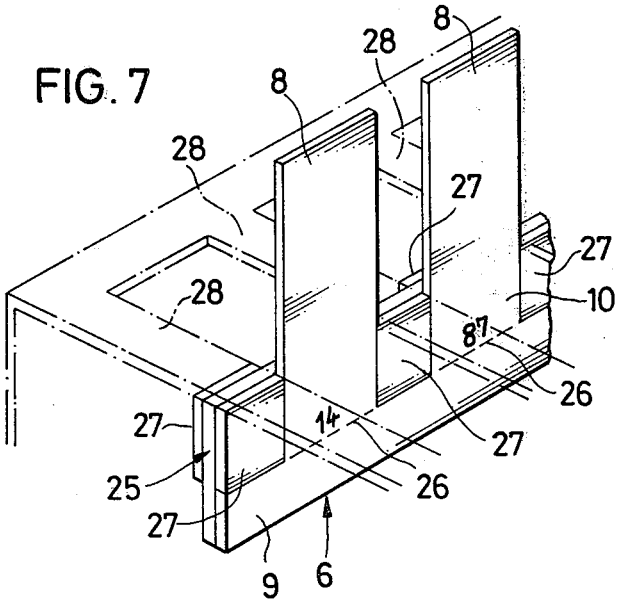
FIG. 7 is a perspective view illustraing a lot strip and a spacer strip according to a still further alternative embodiment.

In the embodiment shown by way of example in FIG. 7, the lottery-ticket strip 6 is somewhat simplified in design, and moreover a spacer strip 25 of a slightly different form is employed. In this case, the ticket strip 6 has a base portion 9 the height of which is low relative to that of the spacer strip 25, whereas the height of the tongues 8 is increased. Each tongue 8 at its bottom end is delimited from the base portion 9 by a tear-off line 26 extending horizontally as an extension of the top edge of the base portion 9. The lot designation (exemplified by numbers "14" and "87") is disposed above and adjacent to said tear-off lines 26.

In the Figure, the tear-off line 26 is shown to be completely continuous, but this line could also be broken in a manner to cause the tongue 8 to merge into the base portion 9 at one or more localities.

The spacer strip 25 has retainer pieces 27 attached to both side faces, and these retainer pieces 27 are arranged to project above the base portion 9 in the spaces between the tongues so as to prevent the base portion 9 from getting pulled up and, at the same time, to form guiding recesses for the tongues 8. The retainer pieces 27 may consist of separate elements which, for instance, are glued to the spacer strip 25, or they may be made integral with the spacer strip by pressing the latter so as to form upstanding portions.

In order (in addition to the protection against pulling-up obtained by the spacer strip 25 and base portions 9 through their fixation) to further protect the spacer strip and base portions 9 against pulling-up action, wall portions of the case or container 1 may include pocket portions 28 extending above the spacer strip 25 and between the tongues 8, these pocket portions preferably extending from one side wall of the container 1 across the lottery-ticket set to the opposite side wall of the container 1. Such pocket portions 28 are diagrammatically indicated by dot-and-dash lines in FIG. 7.

The ticket strips 6 are arranged in a ticket set in which the spacer strips are disposed between the ticket strips and edge to edge with the base portions 9. If only folded portions 24 are used as spacers, the last-mentioned step will, of course, be omitted. The ticket set is then placed in the bottom part 2 and the base portions 9 of all the ticket strips 6 are fixedly attached to the bottom of this bottom part.

It is preferable to provide such attachment by the aid of an adhesive. For this purpose, an adhesive layer 25 (e.g. of glue) is applied to the top surface of the bottom member of the bottom part 2, after which the stack of tickets is pressed into the adhesive layer 25 before the latter will have had time to dry, so that adhesive will come into contact with the base portions 9 of the ticket strips and with the spacer strips 17, 18, or 20, thus fixedly anchoring these elements to the bottom part 2 upon curing, drying or setting of the adhesive. The seal will be quite satisfactory because the stack of tickets can be so disposed in the bottom part 2 as to cause some of the adhesive to penetrate upward between the base portions 9 and the spacer strips 17, 18, or 20, thereby ensuring the necessary contact thereof with the base portions 9 and the spacer strips.

If it should be necessary for the adhesive to come into contact with large portions of the base portions 9, then the spacer strips 17, 18, or 20 may be provided with recesses, holes or the like into which the adhesive can penetrate as the ticket stack is inserted in place.

The anchorage of the base portions 9 of the ticket strips and of the spacer strips 17, 18, or 20, alternatively, could be realized by means of strings (not shown) which are threaded through holes (not shown) made in the side walls 4 of the bottom part 2 and in the base portions of the ticket strips and in the spacer strips and which are then sealed to the sides of the bottom part 2 of the container. This sealing method could be combinated with the adhesive method previously described.

After such sealing of the stack of lottery-tickets, the ticket package is completed, and drawing can be made by selecting any of the tongues 8, gripping the same and pulling the ticket thus selected upward whereby the connection of the pulling portion 10 with the base portion 9 of the tongues will break. Upon pulling the pulling portion 10 further upward, it will finally slide out of the clearance between the spacer strips, and not until this moment the lot number — or designation — will be rendered visible. The torn-off pulling portion 10 will be prevented from any re-insertion into said clearance owing to the presence of the re-insertion guards of the spacer strips or, where such guards are omitted, by the ticket stack being compressed sufficiently forcefully to cause the clearance to close as soon as the pulling portion has left the same.

It is advantageous, though not necessary, to enable the ticket stack to be completely enclosed in the container 1; the container may be constructed in any of numerous ways — thus it is possible, for example, to omit the top part 5 thereof. Further design and manufacturing possibilities may be resorted to within the scope of the appended claims. A re-insertion protection can be effected, for example, by providing each spacer strip 17 with windows, one window per lottery-ticket. Owing to such windows having a width equal to or slightly greater than the width of the pulling portions 10, a sufficiently long edge will be obtained which forms the re-insertion guard. The windows are disposed above the lot designations of the pulling portions 10 in order not to loose the protection against visual observation of lot designations offered by the spacer strips. Furthermore, each tongue 8 may be delimited from the base portion 9 by tear-off lines (not shown) which extend substantially vertically through the base portion 9, preferably in the form of extensions of the vertical side edges of the tongue.

What is claimed is:

1. A lottery ticket assembly, comprising:

a container;

a plurality of lottery ticket strips mounted in an upstanding position in said container, each lottery ticket strip including a common base portion and a plurality of upwardly projecting, spaced lottery tickets, each of said lottery tickets comprising: a pulling portion formed from said base portion, said pulling portion being defined by spaced, generally parallel side tear-off lines and a bottom tear-off line and projecting upwardly from said base portion, and being adapted to carry a lottery ticket designation thereon; an upwardly extending tongue portion integral with said pulling portion between said side tear-off lines, and defined by a top edge, and generally parallel side edges that lie outside said parallel side tear-off lines; and frangible bridge portions on either side of said pulling portion lying between said side tear-off lines and said side edges, and connecting said tongue portion with said base portion, said bridge portions being weakened by tear-off lines extending laterally outwardly from the side tear-off lines of said pulling portion toward said side edges of said tongue portion, said laterally extending tear-off lines terminating short of said tongue portion side edges whereby said tongue portion remains integrally joined with said bridge portions and said base portion; and spacer strips disposed in alternating relationship between the base portions of said lottery ticket strips, and adapted to hide lottery designations carried on said pulling portions.

2. A lottery ticket assembly according to claim 1, wherein said laterally extending tear-off lines weakening said bridge portions are spaced above the spacer strips.

3. A lottery ticket assembly according to claim 1, wherein the spacer strips are provided with means to prevent reinsertion of lottery tickets separated from the base portions and removed from between two spacer strips.

4. A lottery ticket assembly according to claim 1, wherein each spacer strip is provided with a window for each ticket, said windows having a width corresponding at least to the width of the pulling portion and said windows being disposed above the lottery ticket designations of the tickets.

* * * * *